US006287241B1

(12) United States Patent
Ellis

(10) Patent No.: US 6,287,241 B1
(45) **Date of Patent: *Sep. 11, 2001**

(54) LEG PRESS WITH COMPOSITE MOTION

(75) Inventor: Joseph K. Ellis, Lawrenceville, GA (US)

(73) Assignee: Metal Resources, Inc., Dacula, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/488,504

(22) Filed: Jan. 20, 2000

(51) Int. Cl.[7] ..... A63B 21/068; A63B 23/04

(52) U.S. Cl. ..... 482/96; 482/97; 482/100; 482/137

(58) Field of Search ..... 482/72, 79, 95–101, 482/135–137, 142

(56) References Cited

U.S. PATENT DOCUMENTS

| | | | | |
|---|---|---|---|---|
| 2,252,156 | * | 8/1941 | Bell | 482/96 |
| 4,149,714 | | 4/1979 | Lambert, Jr. . | |
| 4,828,254 | | 5/1989 | Maag . | |
| 4,878,663 | * | 11/1989 | Luquette | 482/100 |
| 4,949,958 | * | 8/1990 | Richey | 482/96 |
| 5,106,080 | | 4/1992 | Jones . | |
| 5,299,997 | * | 4/1994 | Chen | 482/96 |
| 5,330,405 | * | 7/1994 | Habing et al. | 482/96 |
| 5,346,447 | * | 9/1994 | Stearns | 482/96 |
| 5,366,432 | | 11/1994 | Habing et al. . | |
| 5,484,365 | | 1/1996 | Jones et al. . | |
| 5,554,086 | | 9/1996 | Habing et al. . | |
| 5,580,340 | * | 12/1996 | Yu | 482/96 |
| 5,616,107 | | 4/1997 | Simonson . | |
| 5,795,270 | | 8/1998 | Woods et al. . | |

OTHER PUBLICATIONS

Metal Resources, Inc. HQ Line color brochure.
Metal Resources, Inc. HQ Line black & white brochure.

* cited by examiner

*Primary Examiner*—Mickey Yu
*Assistant Examiner*—Victor Hwang
(74) *Attorney, Agent, or Firm*—Technoprop Colton LLC

(57) ABSTRACT

A leg press exercise apparatus with composite motion movement combining a moving actuating member and a moving user support, the leg press having a support member, a frame on which the user support is located, the frame being pivotally connected to the support member, a truck in slidable engagement with the support member and the frame, an actuating member on which a push plate is located, the actuating member being pivotally connected to the support member and operatively connected to the truck, the actuating member being adapted to move between a first position and a second position, and a linking mechanism operatively connecting the actuating member the truck, wherein, when the user pushes the actuating member between the first position and the second position, the truck moves along rails on the support member, forcing the frame to pivot relative to the support member and causing the user to actuate a resistance weight, thus exercising certain of the user's muscles.

16 Claims, 8 Drawing Sheets

LEG PRESS WITH COMPOSITE MOTION

BACKGROUND OF THE INVENTION

1. Technical Field.

This invention relates to the general technical field of exercise equipment and machines and to the more specific technical field of mechanically operated resistance exercise machines designed to strengthen certain leg muscles and muscle groups.

2. Prior Art.

Exercise equipment and machines are available in various configurations and for various purposes. Generally, exercise equipment and machines can be categorized into three broad categories: free weights, mechanically operated resistance machines, and electrically operated resistance machines. Mechanically operated resistance machines can be subcategorized into three broad categories: stack weight resistance operated, free weight resistance operated, and alternative resistance operated. Mechanically operated resistance machines are available for exercising and strengthening various individual muscles, muscle groups and combinations of muscle groups.

Exercise equipment and machines for exercising and strengthening the leg muscles commonly are called leg presses. There are two typical types of leg presses. The first typical leg press has a push plate that can move relative to a frame supporting a stationary seat or other user supporting means. The second typical leg press has a seat or other user supporting means that can move relative to a frame supporting a stationary push plate. Both types of leg presses can operate using a weight stack, free weights, user body weight or other resistance means to supply the desired amount of resistance for exercising the desired leg muscle or muscles.

In the first typical leg press, when the user pushes the push plate forward, the plate either travels on a linear path or, if hinged or pivoted, an arcuate path. Both linear and arcuate paths can induce incorrect biomechanical movement of the user's muscular-skeletal system, thereby causing undesirable stress in various areas of the user's body. In the second typical leg press, when the user pushes against the push plate, the seat or other user supporting means travels in a linear path. As already discussed, such a linear path can induce incorrect biomechanical movement of the user's body, resulting in undesirable stress in various areas of the user's body.

U.S. Pat. No. 4,149,714 to Lambert, Jr. discloses a seated weight lifting leg press exercise machine having a moving push plate and a stationary seat. Lambert '714 is a typical example of a mechanical leg press using weight stacks. The user sits on the seat, bends his knees and places his feet on the push plate, and pushes the push plate by straightening his legs. The push plate travels in an arcuate path and is mechanically connected to a weight stack that can be adjusted to a desired weight. A variable radius cam causes the resistance from the weights to increase during the latter phase of the exercise.

U.S. Pat. No. 4,828,254 to Maag discloses a crank and slider/four-bar variable resistance carriage-type leg press machine having a stationary push plate and a moving seat. Maag '254 is an atypical example of a mechanical leg press using free weights. The user stands on the push plate, bends her knees and places her back against a pad and her shoulders against shoulder pads, and pushes the shoulder pads by straightening her legs. The shoulder pads travel in a linear direction and are mechanically connected to a weight bar that can carry a desired amount of weight. A four-bar linkage causes the resistance from the weights to change during the course of the exercise.

U.S. Pat. No. 5,106,080 to Jones discloses a leg press exercise machine having a stationary seat and two moving push plates, one for each leg. Jones '080 is a typical example of a mechanical leg press using free weights. The user sits on the seat, bends his knees and places each of his feet on one of the push plates, and pushes each push plate by straightening his respective legs. The push plates travel in arcuate paths and each comprise a weight bar that can carry a desired amount of weight. Separate push plates allow independent exercise of each leg.

U.S. Pat. No. 5,366,432 to Habing et al. discloses a leg press having a stationary seat and a moving push plate. Habing '432 is a typical example of a mechanical leg press using a weight stack. The user sits on the seat, bends her knees and places her feet on the push plate, and pushes the push plate by straightening her legs. The push plate travels in a linear path and is mechanically connected to a weight stack that can be adjusted to a desired weight. A pulley and cable system causes the resistance from the weights to change during the course of the exercise.

U.S. Pat. No. 5,484,365 to Jones et al. discloses a leg press exercise machine having a stationary seat and a moving push plate. Jones '365 is another typical example of a mechanical leg press using a weight stack. The user sits on the seat, bends his knees and places his feet on the push plate, and pushes the push plate by straightening his legs. The push plate travels in an arcuate path and is mechanically connected to a weight stack that can be adjusted to a desired weight. A parallel link system, a pair of weight stacks and a counterweight cause the need for overhead connections between the push plate and the weight stack and eliminate the slack inherent in cable systems.

U.S. Pat. No. 5,554,086 to Habing et al. discloses a leg press exercise apparatus having a stationary push plate and a moving seat. Habing '086 is an atypical example of a mechanical leg press using a weight stack. The user sits on the seat, bends her knees and places her feet on the push plate, and pushes the seat by straightening her legs. The seat travels in an arcuate direction and is mechanically connected to a weight stack that can be adjusted to a desired weight. The Habing '086 device is intended to be an add-on feature for a multi-station exercise machine.

U.S. Pat. No. 5,616,107 to Simonson discloses a method and apparatus for leg press exercise with counterbalance having a stationary seat and a moving push plate. Simonson '107 is another typical example of a mechanical leg press using a weight stack. The user sits on the seat, bends his knees and places his feet on the push plate, and pushes the push plate by straightening his legs. The push plate travels in an arcuate path and is mechanically connected to a weight stack that can be adjusted to a desired weight. A counterweight counterbalances the inherent resistance of the leg press machine over the range of the exercise.

U.S. Pat. No. 5,795,270 to Woods et al. discloses a semi-recumbent arm and leg press and aerobic exercise apparatus having a stationary seat and a moving push plate. Woods '270 is an atypical example of a mechanical press using air resistance. The user sits on the seat, bends her knees and places her feet on the push plate, and pushes the push plate by straightening her legs. Air resistance means are mechanically coupled to the push plate and are actuated by pushing the push plate. The user continuously pushes and releases the push plate, achieving both leg press and aerobic exercise. A similar mechanism also is included for exercising the upper body.

The previously described art comprises a general cross-section of the leg press art as it is today. As can be seen, individual apparatuses have either a stationary seat and a moving push plate or a moving seat and a stationary push plate, but not a combination. Further, individual apparatuses have either a linear travel path or an arcuate travel path, but not a combination or a path that more closely resembles the actual biomechanical path of the human body in motion. Individual apparatuses also either use weight stacks, free weights, user body weight or air resistance, or other single resistance mechanisms, and only a small number of apparatuses combine weight stacks or free weights with the user's body weight.

Thus it can be seen that a leg press exercise machine comprising a combination moving seat and moving push plate, an improved travel path more closely resembling the actual biomechanical path of the human leg in motion, and a combination resistance using weight stacks or free weights and the user's body weight would be useful, novel and not obvious, and a significant improvement over the prior art. It is to such leg press exercise machine that the current invention is directed.

BRIEF SUMMARY OF THE INVENTION

The present invention is a leg press that comprises a composite motion movement in which both the user support and the actuating member move. In the preferred embodiment, the leg press comprises both a moving user support and a moving actuating member. The user support, in this instance a backrest, is mounted on a frame that is pivotally connected to a support member and that rides upon a truck. The actuating member also is pivotally connected to the support member via a support bar that also is mechanically coupled to the truck. The truck rides upon rails that are an integral part of the support member. The frame further may comprise or may be mechanically coupled to a supplemental weight resistance means.

According to a preferred embodiment of the invention, the user support has a supine orientation and is located on the top side of the frame. The user support further comprises shoulder pads and hand grips at the head end that the user engages when operating the machine. The frame is pivotally coupled to the support member at the foot end. The frame pivots generally upward and downward in an arcuate path relative to the support member. Running along the length of the bottom side of the frame is one or more rail for engaging the truck. The shoulder pads and hand grips can be adjustable relative to the user support based on the size of the user. Supplemental weight resistance means can be coupled to the frame preferably at the head end.

The actuating member is located proximal to the foot end of the frame and is pivotally coupled to the support member. Typically, the actuating member is coupled to the support member at a location proximal to where the frame is coupled to the support member. The actuating member further comprises a push plate and a support bar for supporting the push plate on the support member and for operatively coupling the actuating member to the truck. The actuating member pivots generally horizontally in an arcuate path relative to the support member. The push plate can be adjustable relative to the support bar based on the size of the user.

The support member is a generally H-shaped component that lays flat on the floor or other supporting surface. The frame and actuating member are pivotally connected on or near a first side of the H. Both sides of the H provide stability for the machine. One or more rail for carrying the truck is or is located along a portion of the center portion of the H.

The truck is located between the frame and the support member and is slidably connected to both via the rails. The truck is a hinged component comprising a top portion pivotally hinged to a bottom portion. Top bearings located on the top portion of the truck cooperate with the rail or rails running along the bottom side of the frame, and bottom bearings located on the bottom portion of the truck cooperate with the rail or rails running along the center portion of the support member. The truck slides generally linearly along the rail or rails running along the center portion of the support member. The truck also is separately connected to the frame via a belt that travels through a pulley connected to the support bar of the actuating member.

In operation, the user lies supine on the user support, bends his or her knees to the proper angle and places his or her feet on the push plate. The push plate is adjusted up or down on the support bar to the proper height so that the user's feet are at an acceptable position on the push plate. The angle of the push plate also can be adjusted relative to the support bar. The shoulder pads can be adjusted forward or backward relative to the user support to the proper position to snugly engage the user's shoulders. The user then initiates the exercise motion by straightening his or her legs, forcing the push plate away from the user and the frame.

The exercise motion causes several actions. Pushing the push plate causes the actuating member to pivot about the connection between the support bar and the support member and to be forced away from the frame. The movement of the actuating member also moves the pulley, which is attached to the support bar, and acts upon the belt connecting the truck to the frame and traveling through the pulley. The truck is pulled along the rail or rails running along the center portion of the support member in the same general direction as the movement of the actuating member. The movement of the truck acts like a wedge between the frame and the support member and forces the frame to pivot about the connection between the frame and the support member, and the head end of the frame moves upwards and away from the support member. The hinge between the top portion of the truck and the bottom portion of the truck allows the top bearings to maintain smooth contact with the rail or rails running along the bottom side of the frame, and allows the bottom bearings to maintain smooth contact with the rail or rails running along the center portion of the support member.

Weight resistance is provided by the weight of the user, the weight of the frame and the weight of any supplemental resistance weights attached to the machine. The machine is capable of at least two separate exercise regimens. First, the user can exercise the upper leg muscles by repetitiously straightening the legs, forcing the actuating member from a first position proximal to the user to a second position distal from the user, and then bending the legs, allowing the actuating member to return from the second position to the first position. Second, the user can exercise the calf muscles by straightening the legs, forcing the actuating member from a first position proximal to the user to a second position distal from the user, holding the actuating member at the second position, and then repetitiously contracting and releasing the calf muscles thus pushing the actuating member an additional distance distal from the user.

The combined motion of the frame and the actuating member alters the biomechanical movement of the user's body to a composite motion somewhere between linear and a true arc, more closely resembling the accurate biomechanical motion of the human body. Additionally, this composite motion has the added advantage of helping the user's feet maintain continuous and more even contact with the push plate, rather than causing the user's feet to rotate forcing the balls of the feet or heels of the feet to have more or less contact with the push plate as in much of the prior art, thus reducing the overall stress to individual parts of the user's feet. Further, this composite motion has the added advantage of helping the user's back maintain continuous and more even contact with the user support, rather than causing the user's back to arch away from the user support as in much of the prior art, thus reducing the overall stress to individual parts of the user's back.

Thus, it is an object of the present invention to provide a leg press that allows the user to exercise certain muscles in a more biomechanically correct manner.

It is another object of the present invention to provide a leg press that efficiently exercises certain muscles.

It is another object of the present invention to provide a leg press that causes a reduced amount of stress on certain parts of the user's body that are not the primary focus of the exercise.

These objects, and other objects, features and advantages of the present invention will become more apparent to those of ordinary skill in the art when the following detailed description of the preferred embodiments is read in conjunction with the appended figures.

DETAILED DESCRIPTION OF THE PREFERRED EMBODIMENTS

Figure 1:
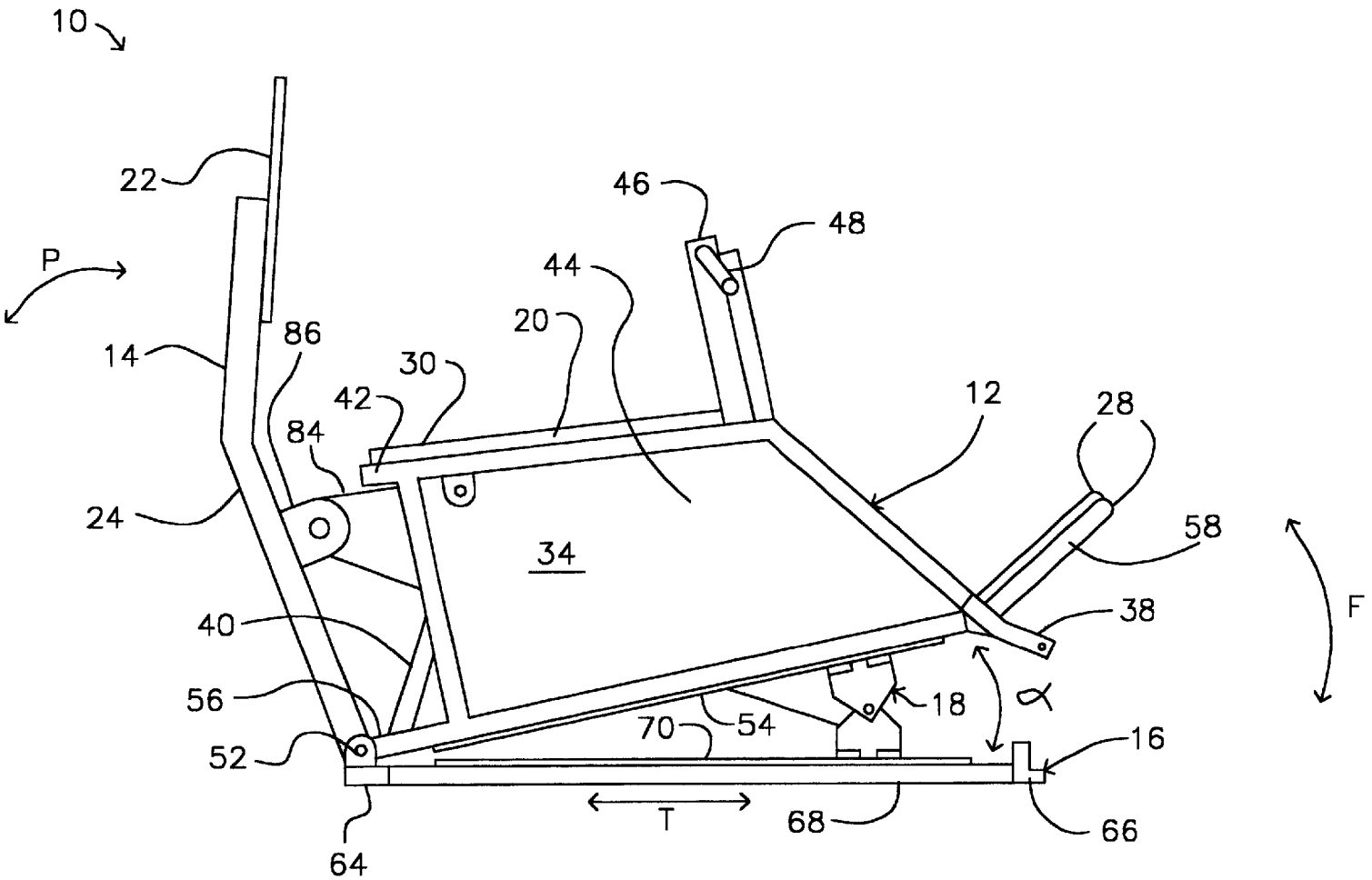
FIG. 1 is a side view of the leg press exercise machine shown in accordance with a preferred embodiment of the present invention at the first position of the exercise movement.
Figure 2:
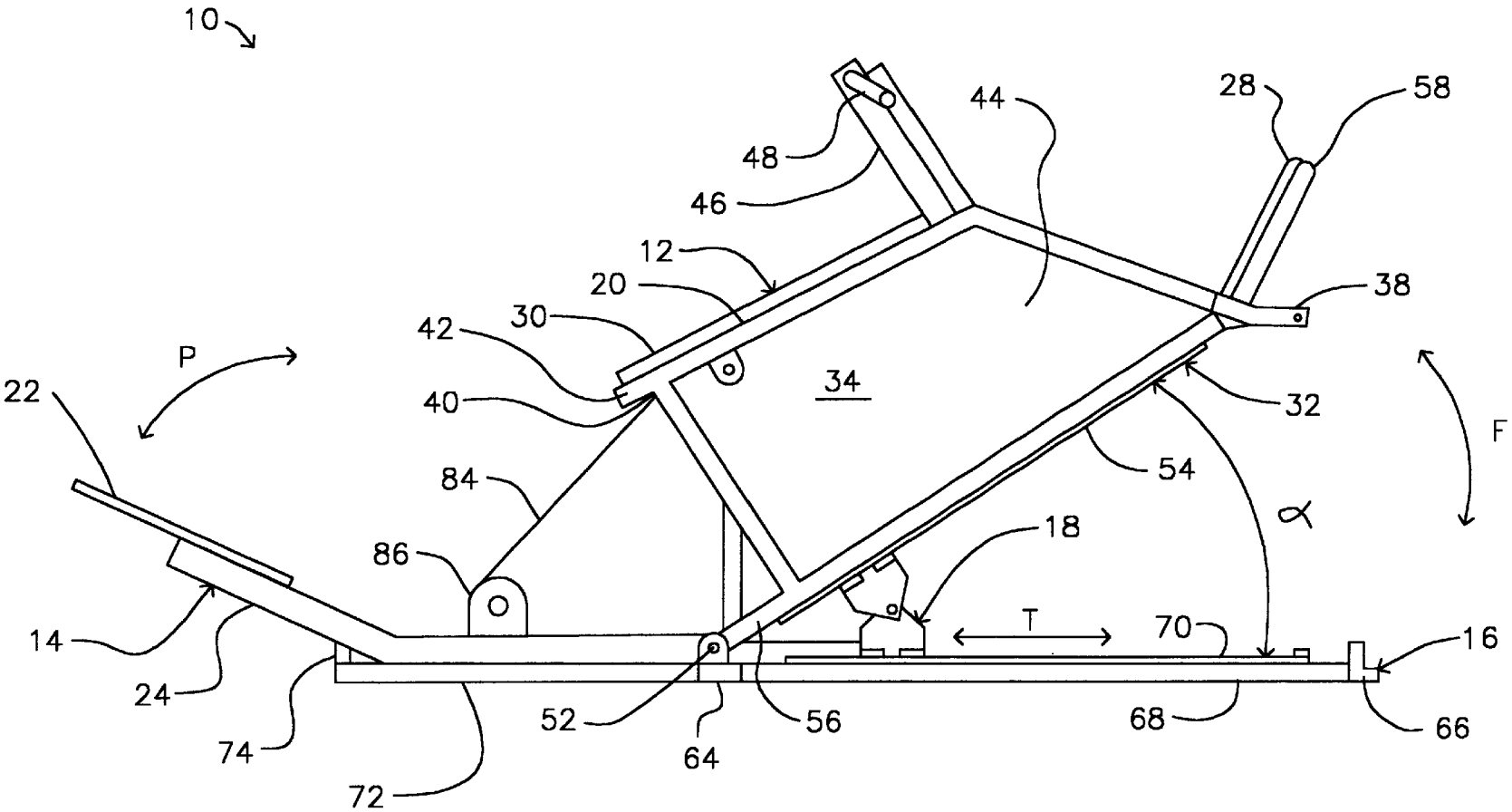
FIG. 2 is a side view of the leg press exercise machine shown in FIG. 1 at the second position of the exercise movement.

Referring now to FIGS. 1 through 8, in which like reference numerals represent like components throughout the several views, a leg press exercise machine 10 according to the preferred embodiment is shown. Machine 10 comprises both moving user support 20 and moving actuating member 14. User support 20 is mounted on frame 12 that is pivotally connected to support member 16 and that rides upon truck 18. Actuating member 14 also is pivotally connected to support member 16 via support bar 24 that also is mechanically coupled to truck 18. Truck 18 rides upon base rails 70 that are an integral part of support member 16. Frame 12 further may comprise or may be mechanically coupled to a supplemental weight resistance means 28. FIGS. 1 and 2 show a side view of machine 10, which comprises frame 12, actuating member 14, support member 16 and truck 18.

Referring now to FIGS. 1 and 2, frame 12 is a generally hollow box-like structure comprising top side 30, bottom side, 32, left side 34, right side 36, head end 38 and foot end 40. Frame 12 preferably is made of a number of heavy duty steel tubing sections 42 welded or bolted together to form the desired structure. Panels 44 can be inserted between adjacent sections 42 to form the respective sides. User support 20 is located on top side 30 and has a supine orientation. User support 20 further comprises shoulder pads 46 and hand grips 48 at the head end 38 that the user engages when operating the machine 10. Shoulder pads 46 and hand grips 48 can be adjustable relative to user support 20 based on the size of the user.

Frame 12 is pivotally coupled to support member 16 at foot end 40 using frame rods 50 journaled into frame bearings 52. As shown in FIGS. 1 and 2, the sections 42 making up bottom side 32 preferably are elongated in the direction of foot end 40. As shown in more detail in FIG. 6, elongated sections 56 provide the pivotal connection between frame 12 and support member 16 using frame rods 50 and frame bearings 52. Frame 12 pivots generally upward and downward relative to support member 16 from a first position shown in FIG. 1 to a second position shown in FIG. 2. Frame 12 travels in arcuate path F about the centerline between frame bearings 52.

Running along the length of bottom side 32 of frame 12 are frame rails 54 for engaging truck 18. Rails 54 preferably are elongated steel cylinders securely attached to bottom side 32. If two rails 54 are used, one rail 54 is located on bottom side 32 proximal to left side 34, and another rail 54 is located on bottom side 32 proximal to right side 36. As shown in more detail in FIG. 7, rails 54 are generally coextensive with the length of bottom side 32.

Supplemental weight resistance means 28 can be coupled to frame 12 preferably at head end 38. As shown in FIGS. 1 and 2, supplemental weight resistance means 28 can be free weight support rods 58 extending outwardly from head end 38. Alternatively, free weight support rods 58 may extend outwardly from left side and right side instead of or in addition to from head end 38. Although two free weight support rods 58 are shown, the number of free weight support rods is variable. There are many alternatives for supplemental weight resistance means 28 including linkages to weight stacks (not shown), air resistance devices (not shown), elastomeric or tension devices (not shown), compression devices (not shown), gas cylinders (not shown), and hydraulic cylinders (not shown).

Actuating member 14 is located proximal to foot end 40 of frame 12 and is pivotally coupled to support member 16. Preferably, actuating member 14 is coupled to support member 16 at a location proximal to where frame 12 is coupled to support member 16. Actuating member 14 comprises push plate 22 and support bar 24 for supporting push plate 22 on support member 16 and for coupling actuating member 14 to truck 18. Actuating member 14 pivots generally horizontally in arcuate path P relative to support member 16. Push plate 22 can be adjustable relative to support bar 24 based on the size of the user. As shown in FIGS. 1 and 2, support bar 24 preferably is an angled component in the preferred embodiment. This is for practical purposes in that the angle allows more range of motion for the exercise and properly positions the user's feet on the push plate 22 relative to the user's position on the user support 20. Additionally, the angle in support bar 24 can provide additional room between frame 12 and actuating member 14 to accommodate both the user's legs and the pulley system described later. Alternatively, support bar 24 can be straight or curved.

Actuating member 14 is pivotally coupled to support member 16 using member rods 60 journaled into member bearings 62. As shown in more detail in FIG. 6, the lower end of support bar 24 provides the pivotal connection between actuating member 14 and support member 16 using member rods 60 and member bearings 62. Actuating member 14 pivots relative to support member 16 from a first position shown in FIG. 1 to a second position shown in FIG. 2. Actuating member 14 travels in arcuate path P about the centerline between member bearings 62.

Support member 16 is a generally H-shaped component that lays flat on the floor or other supporting surface. Frame 12 and actuating member 14 are pivotally connected on or near a first side 64 of support member 16. Both first side 64 and second side 66 of support member 16 provide stability for the machine 10. One or more base rail 70 for carrying truck 18 is or is located along a portion of the center portion 68 of support member 16. As shown in more detail in FIG. 7, base rail extends generally along the length of center portion 68 of support member 16.

Figure 6:
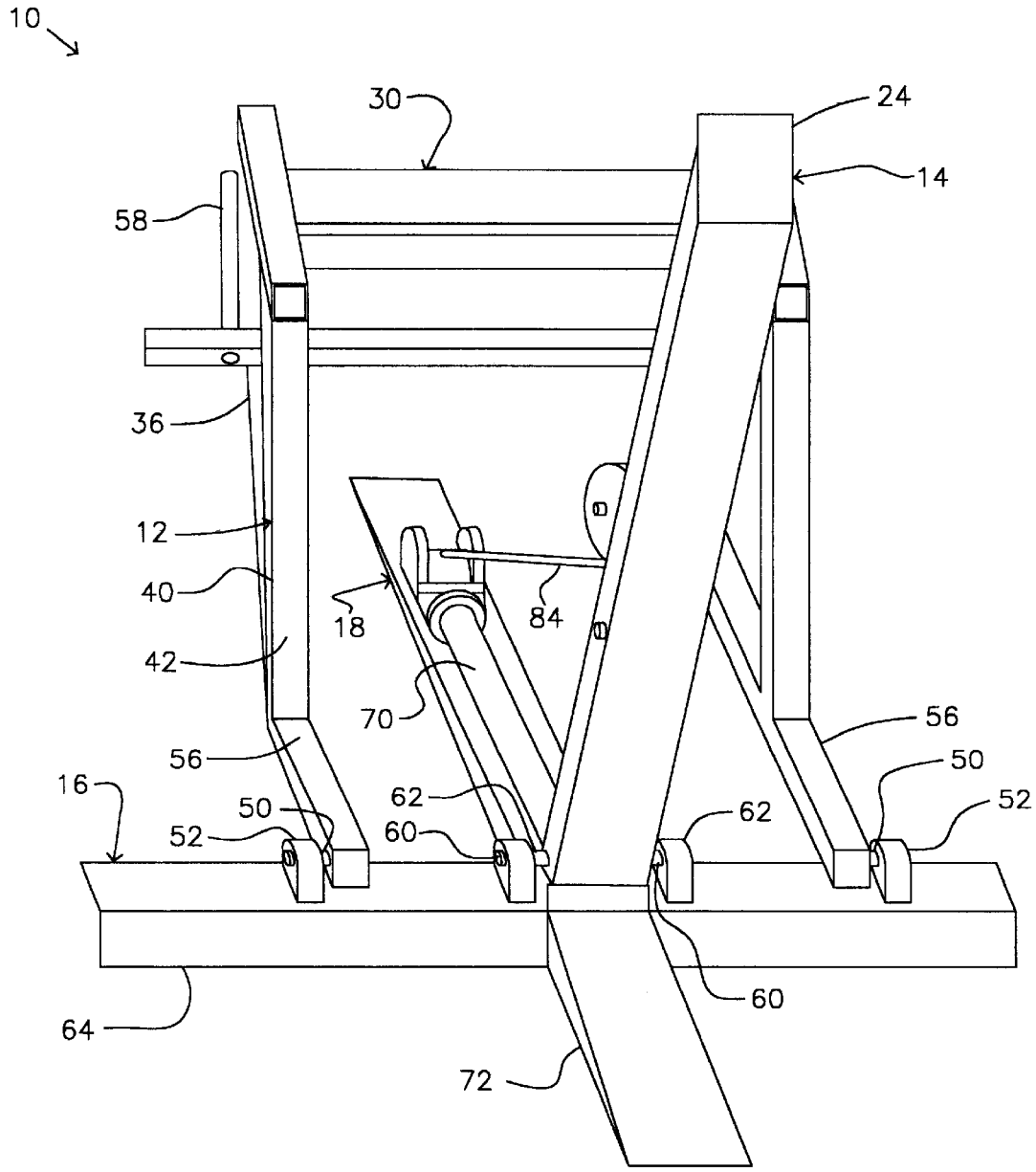
FIG. 6 is a front view of the leg press exercise machine shown in FIG. 1.
Figure 7:
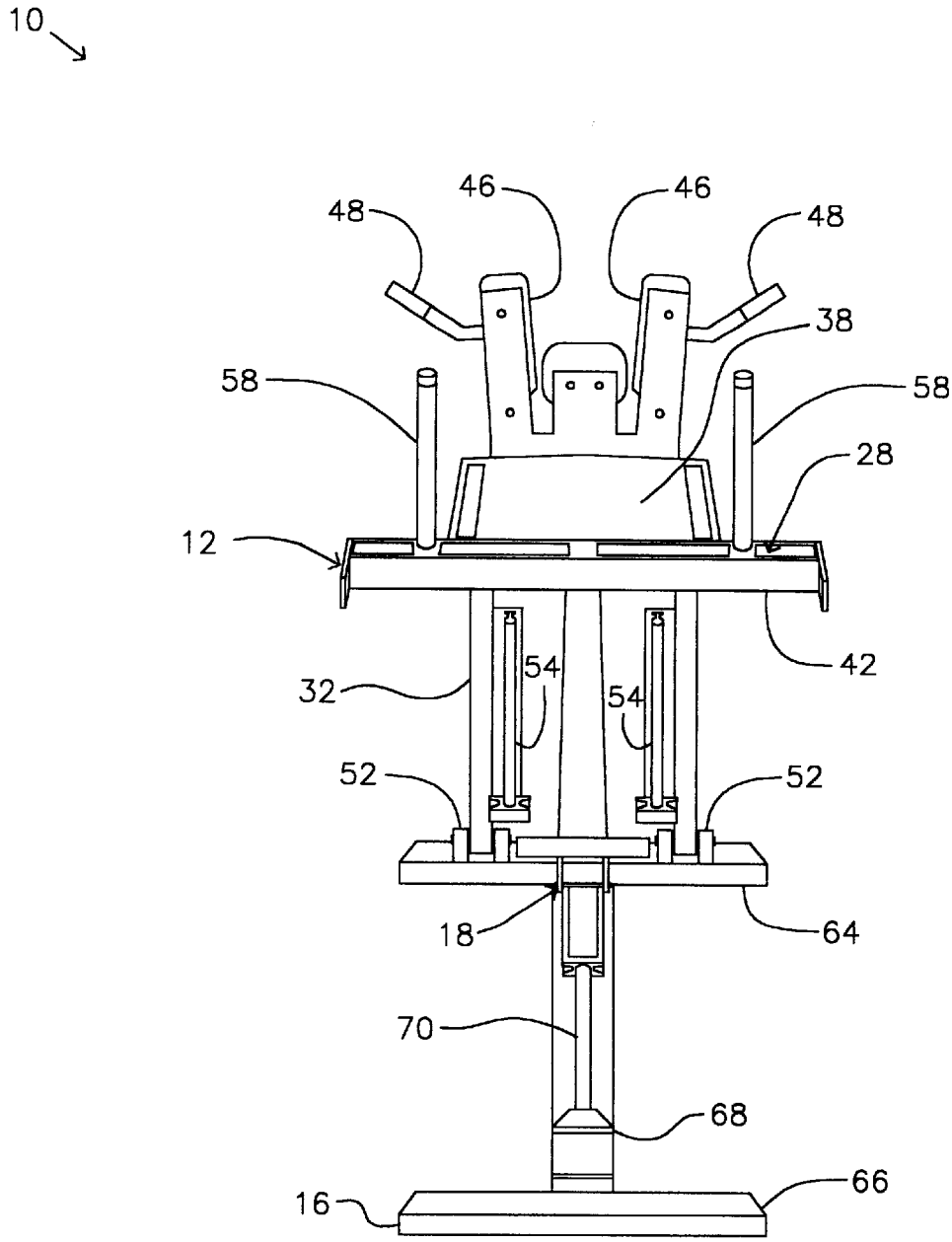
FIG. 7 is a rear view of the leg press exercise machine shown in FIG. 1.
Figure 8:
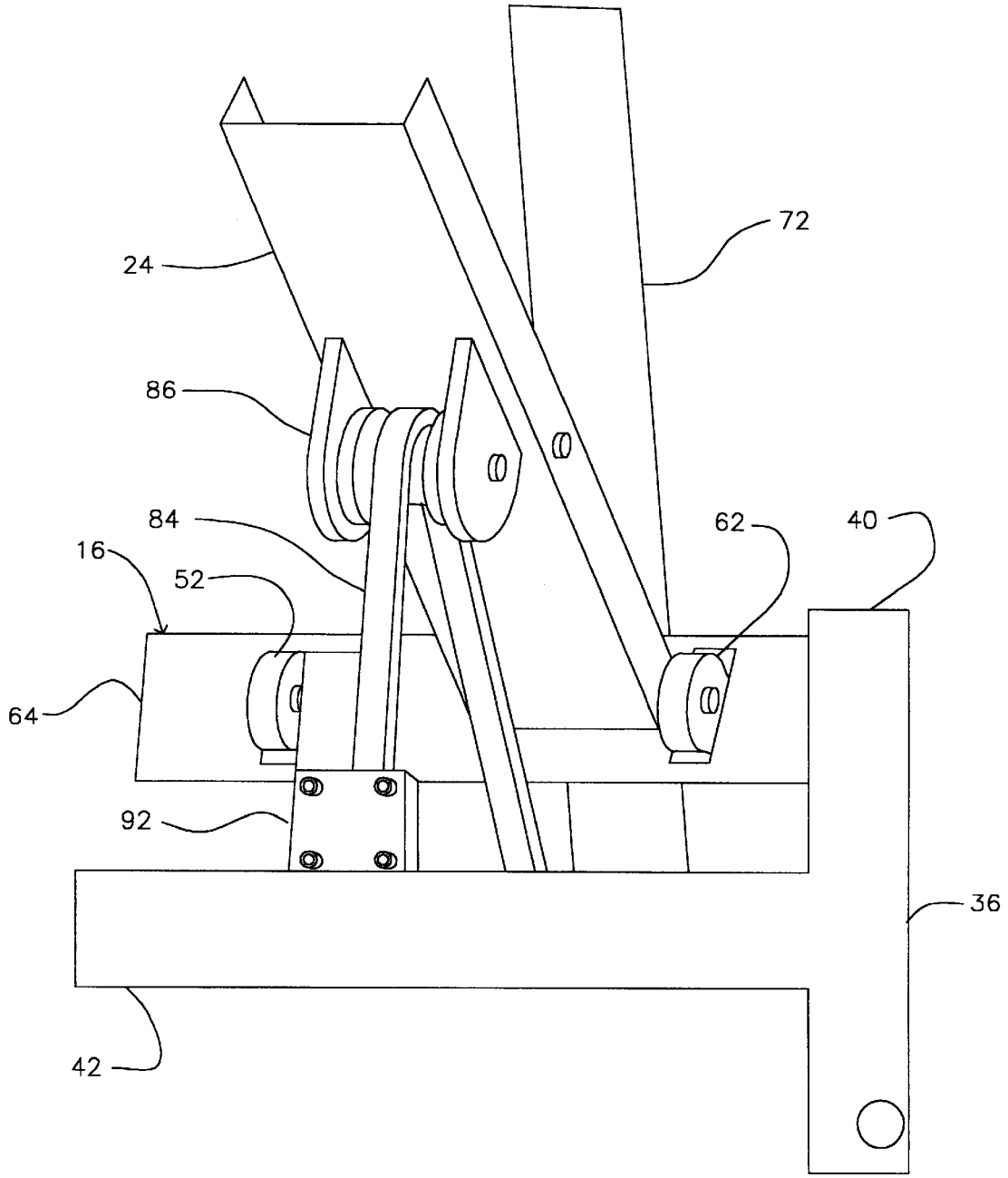
FIG. 8 is a view of the drive mechanism for the leg press exercise machine shown in FIG. 1.

As shown in more detail in FIG. 6, in the preferred embodiment, frame bearings 52 and member bearings 62 are mounted on first side 64 of support member 16. Also in the preferred embodiment, the centerlines of frame bearings 52 and member bearings 62 are collinear, allowing both frame 12 and actuating member 14 to pivot about the same axis. Support member 16 also may have extension 72 extending from first side 64 collinearly with center portion 68. As an alternative, member bearings 62 may be located on extension 72. In this situation, the centerlines of frame bearings 52 and member bearings 62 are not collinear, and frame 12 and actuating member 14 do not pivot about the same axis. Additionally, extension 72 can comprise actuating member stop 74 for delineating the farthest extent actuating member 14 may travel.

Figure 3:
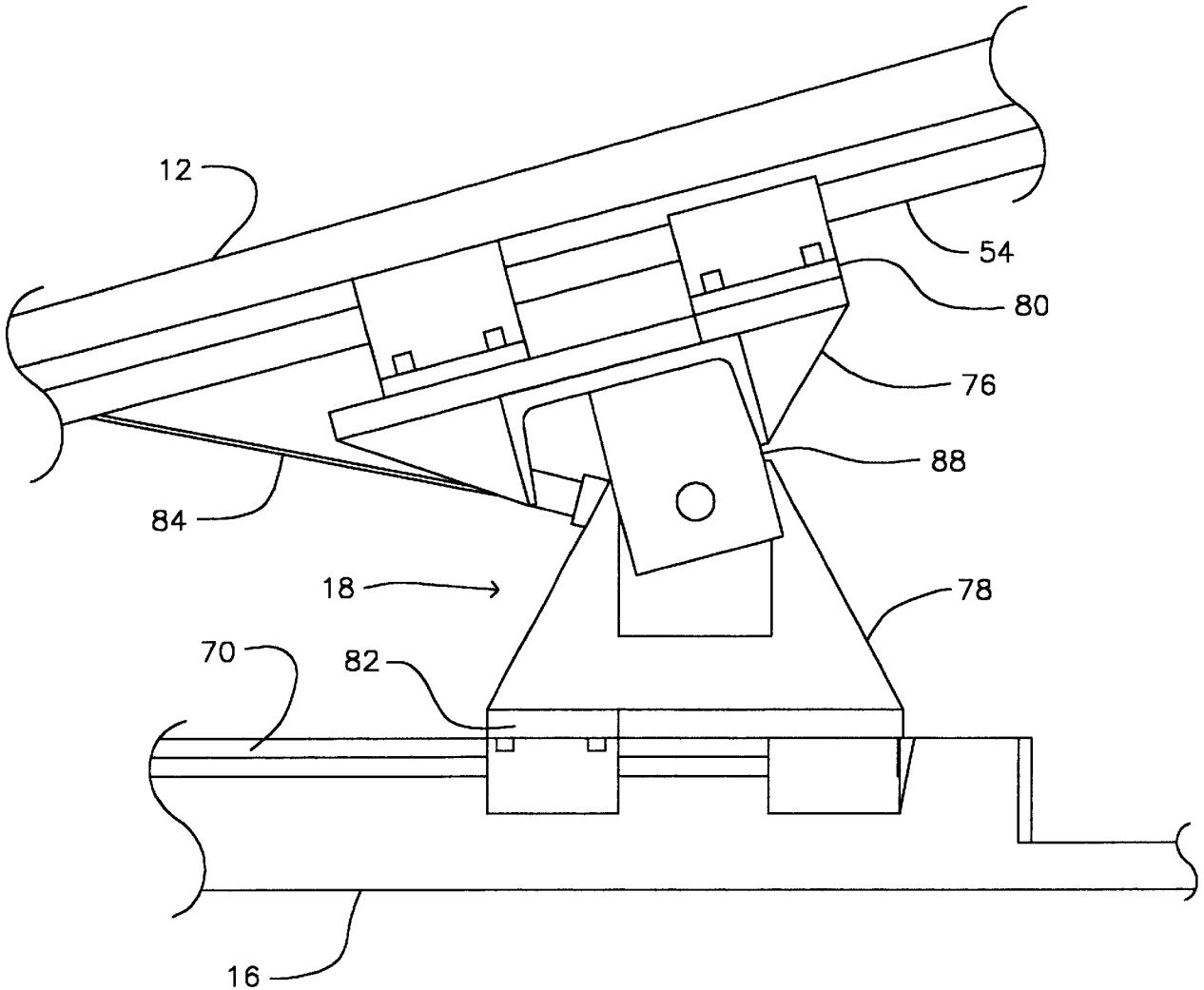
FIG. 3 is a side view of the support truck of the leg press exercise machine shown in FIG. 1 at the first position of the exercise movement.
Figure 4:
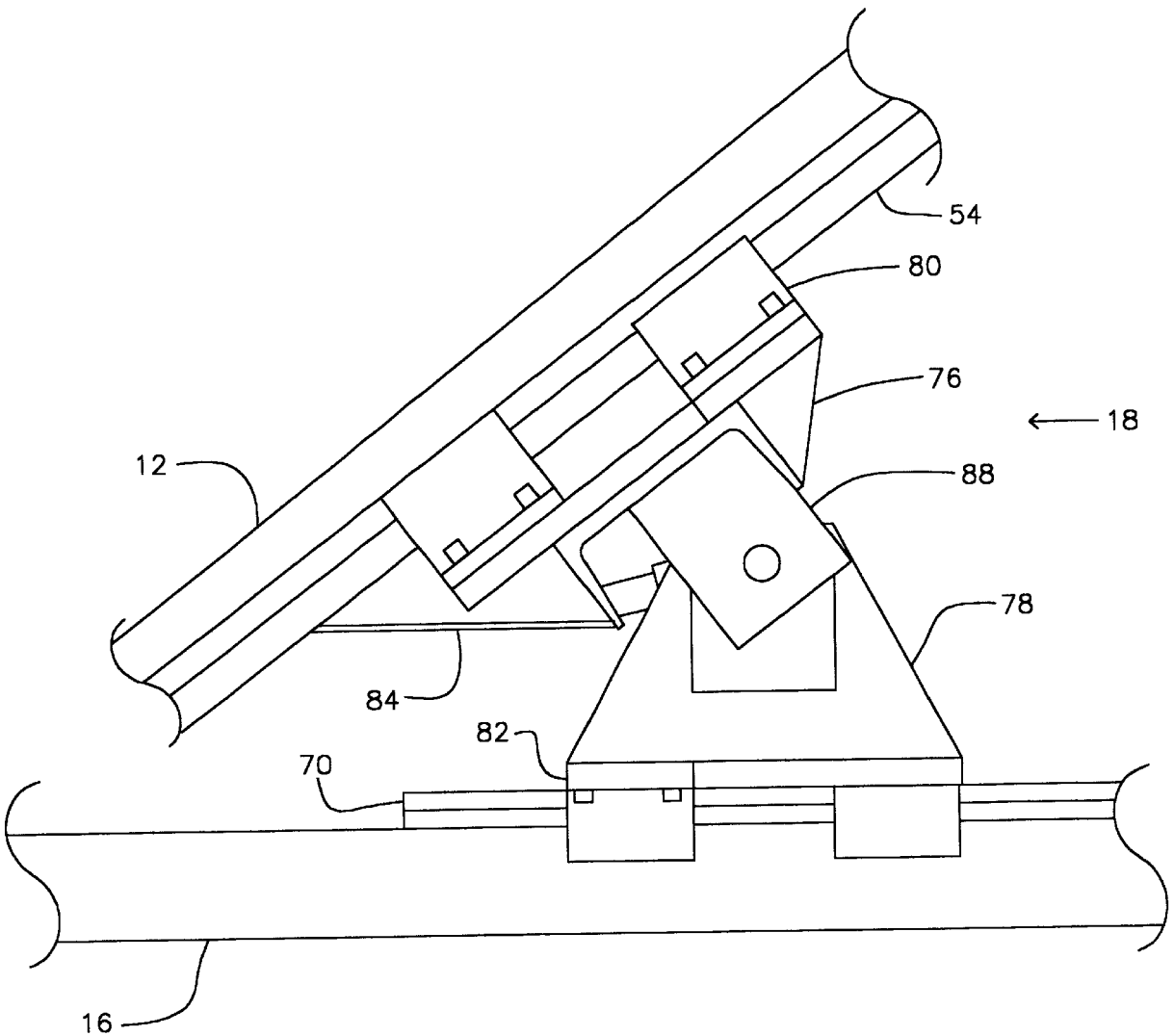
FIG. 4 is a side view of the support truck of the leg press exercise machine shown in FIG. 1 at the second position of the exercise movement.
Figure 5:
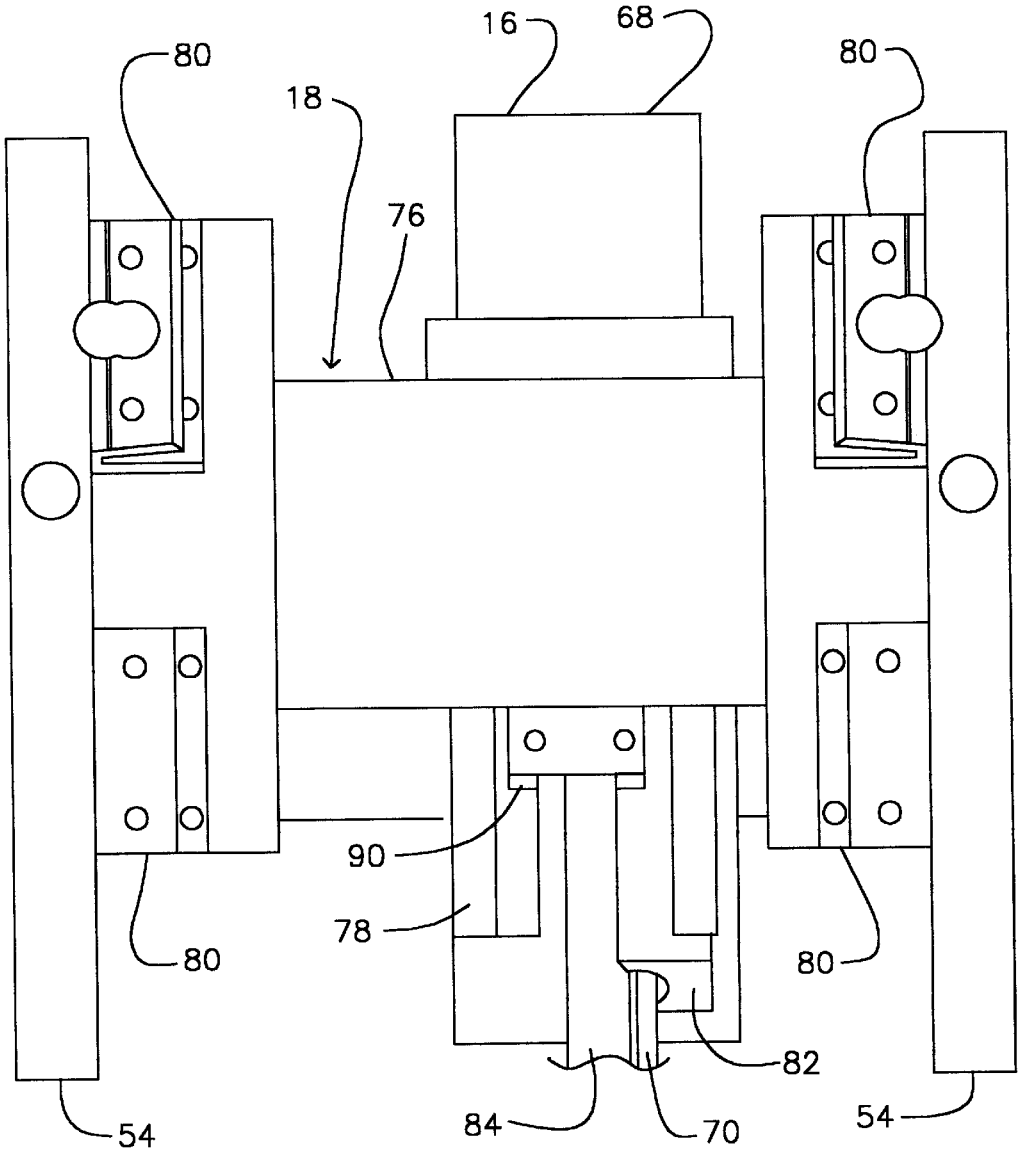
FIG. 5 is a top view of the support truck of the leg press exercise machine shown in FIG. 1.

Truck 18 is located between frame 12 and support member 16 and is slidably connected to frame 12 by frame rails 54 and to support member 16 by base rail 70. As shown in more detail in FIGS. 3 through 5, truck 18 is a hinged component comprising a top portion 76 pivotally hinged to a bottom portion 78. Frame or top bearings 80 located on top portion 76 of truck 18 cooperate with frame rails 54 running along bottom side 32 of frame 12, and base or bottom bearings 82 located on bottom portion 78 of truck 18 cooperate with base rail 70 running along center portion 68 of support member 16. Truck 18 slides generally linearly along path T along base rail 70 from a first position as shown in FIGS. 1 and 3 to a second position as shown in FIGS. 2 and 4. Truck 18 also is separately connected to frame 12 by belt 84 that travels through pulley 86 connected to support bar 24 of actuating member 14.

As truck 18 is pulled along path T by the movement of actuating member 14, truck 18 acts analogously to a wedge between frame 12 and support member 16. When pressure is applied to push plate 22, truck 18 is pulled by actuating member 14 from the first position shown in FIGS. 1 and 3 to the second position shown in FIGS. 2 and 4 forcing frame 12 to pivot upwards along path F. When pressure is released from push plate 22, truck 18 is forced by the weight of frame 12, as well as the weight of the user and any resistance weights coupled with frame 12, from the second position shown in FIGS. 2 and 4 to the first position shown in FIGS. 1 and 3. As frame 12 pivots relative to support member 16, the angle a between frame 12 and support member 16 changes. Hinge 88 allows top portion 76 to rotate relative to bottom portion 78 as truck 18 moves from the first position to the second position such that the angle between top portion 76 and bottom portion 78 matches angle a.

Truck 18 is operatively coupled to actuating member 14. Although truck 18 can be operatively coupled directly to actuating member 14, it is preferred that truck 18 be coupled directly to frame 12 and coupled indirectly to actuating member 14. The preferred coupling mechanism is shown in more detail in FIGS. 5, 6 and 8. A first end of belt 84 is securely attached to truck 18, preferably with a first clamp 90. Belt 84 then passes over pulley 86 that is mounted on actuating member 14, preferably on support bar 24. A second end of belt 84 is securely attached to frame 12, preferably with a second clamp 92. Pressure on actuating member 14 away from frame 12 causes tension in belt 84, pulling truck 18 along path T towards actuating member 14. Additionally, pressure on actuating member 14 away from frame 12 causes tension in belt 84, pulling frame 12. The combined pulling of truck 18 and frame 12 causes frame 12 to rotate about path F. Although a belt and pulley linking mechanism is described as the preferred embodiment, alternatives are suitable. For example, the belt can be of any known structure, such as steel cables, wound cables, wire, polymer tows, carbon fiber, tension devices, bar linkages, and elastomers. Likewise, the pulley can be any direction changing device, such as gears, Teflon® or other slippery material rods, and elbow-shaped components. Both clamps 90, 92 can be pivotally connected to truck 18 and actuating member 14, respectively, such that as machine 10 moves through its range of motion, belt 84 and clamps 90, 92 can pivot, reducing stress on belt 84.

In operation, the user lies supine on the user support 20, bends his or her knees to the proper angle and places his or her feet on push plate 22. Push plate 22, if adjustable, can be adjusted up or down on support bar 24 to the proper height and/or angled forward or backward relative to support bar 24, so that the user's feet are at an acceptable position on push plate 22. Shoulder pads 46 and hand grips 48 can be adjusted forward or backward relative to user support 20 to the proper position to snugly engage the user's shoulders. The user then initiates the exercise motion by straightening his or her legs, forcing push plate 22, and thus actuating member 14, from the first position proximal to the user and frame 12 to the second position distal from the user and frame 12.

The exercise motion causes several actions. Pushing push plate 22 causes actuating member 14 to pivot about the connection between support bar 24 and support member 16 and to be forced away from frame 12. The movement of actuating member 14 also moves pulley 86, which is attached to support bar 24, and acts upon belt 84 connecting truck 18 to frame 12 and traveling through pulley 86. Truck 18 is pulled along the base rail 70 running along center portion 68 of support member 16 in the same general direction T as the movement P of actuating member 14. The movement T of truck 18 acts analogously to a wedge between frame 12 and support member 16 and forces frame 12 to pivot about the connection between frame 12 and support member 16, and head end 38 of frame 12 moves upwards and away from support member 16 along path F.

Further, because belt 84 preferably is connected to frame 12, the action of pushing actuating member 14 assists in causing frame 12 to travel in arcuate path F. Hinge 88 between top portion 76 of truck 18 and bottom portion 78 of truck 18 allows top bearings 80 to maintain smooth contact with frame rails 54 running along bottom side 32 of frame 12, and allows bottom bearings 82 to maintain smooth contact with the base rail 70 running along center portion 68 of support member 16.

Various supplemental weight resistance means 28 can be used to provide resistance weight for the machine 10. If the user so chooses, the user does not have to add any supplemental weight resistance means 28 to the machine 10 and in this situation the resistive force will be the weight of frame 12 and the weight of the user. The user can place free weights on free weight support rods 58 to increase the resistive force. In an alternative embodiment, a weight stack or other supplemental weight resistance means 28 is attached to the machine 10, by cables, linkages or other coupling means (not shown).

An optional locking mechanism (not shown) can be included on machine 10. Preferably, locking mechanism holds machine at an intermediate position between the first position as shown in FIG. 1 and the second position as shown in FIG. 2. Such a locking mechanism is for convenience reasons. By holding machine 10 in an intermediate position, ingress and egress to machine by the user is simplified, adding to the convenience of machine.

The combined motion, or composite motion movement, of user support 20 and actuating member 14 alters the biomechanical movement of the user's body to a composite motion somewhere between linear and a true arc, more closely resembling the accurate biomechanical motion of the human body. Additionally, this composite motion has the added advantage of helping the user's feet maintain continuous and more even contact with push plate 22, rather than causing the user's feet to rotate forcing the balls of the feet or heels of the feet to have more or less contact with push plate 22, thus reducing the overall stress to individual parts of the user's feet. Further, this composite motion has the added advantage of helping the user's back maintain continuous and more even contact with user support 20, rather than causing the user's back to arch away from user support 20, thus reducing the overall stress to individual parts of the user's back.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. A leg press exercise apparatus, comprising:

a. a support member;

b. a user support frame pivotally connected to said support member;

c. a truck in slidable engagement with said support member and said frame;

d. an actuating member pivotally connected to said support member, said actuating member being adapted to move between a first position and a second position; and e. a linking mechanism operatively coupling said actuating member with said truck and said user support frame;

wherein, when said actuating member moves between said first position and said second position, said truck moves forcing said user support frame to pivot relative to said support member.

2. The exercise apparatus characterized in claim 1, wherein said user support frame comprises at least one frame rail and said truck comprises at least one frame bearing that acts in cooperation with said frame rail.

3. The exercise apparatus characterized in claim 1, wherein said support member comprises at least one base rail and said truck comprises at least one base bearing that acts in cooperation with said base rail.

4. The exercise apparatus characterized in claim 3, wherein said support member further comprises a stop for arresting the motion of said actuating member at the second position.

5. The exercise apparatus characterized in claim 1, wherein said truck comprises a top portion that cooperates with said user support frame, a bottom portion that cooperates with said support member, and a hinge portion that hingedly connects said top portion to said bottom portion.

6. The exercise apparatus characterized in claim 1, wherein said user support frame is pivotable in an arcuate path, said actuating member is pivotable in an arcuate path, and said truck is slidable in a linear path.

7. The exercise apparatus characterized in claim 6, wherein said user support frame, said actuating member, and said truck are all in operative engagement with each other.

8. The exercise apparatus characterized in claim 7, wherein said user support frame pivots about a first pivot axis and said actuating member pivots about a second pivot axis.

9. The exercise apparatus characterized in claim 8, wherein said first pivot axis and said second pivot axis are collinear.

10. The exercise apparatus characterized in claim 8, wherein said first pivot axis and said second pivot axis are parallel.

11. The exercise apparatus characterized in claim 1, further comprising a resistance weight.

12. The exercise apparatus characterized in claim 11, wherein said resistance weight is selected from the group consisting of free weights, and weight stacks.

13. The exercise apparatus characterized in claim 1, wherein said linking mechanism comprises a belt and a pulley.

14. The exercise apparatus characterized in claim 13, wherein said belt comprises a first end attached to said truck and a second end attached to said user support frame.

15. The exercise apparatus characterized in claim 1, wherein said user support frame allows a user to lay on said user support frame in a supine position.

16. The exercise apparatus characterized in claim 15, wherein said user support frame further comprises at least one shoulder pad.

* * * * *